US006020304A

United States Patent [19]

Ceulemans et al.

[11] Patent Number: 6,020,304

[45] Date of Patent: Feb. 1, 2000

[54] FABRIC SOFTENER COMPOSITIONS

[75] Inventors: Raphael Angeline Alfons Ceulemans, Lubbeek; Franciscus Joseph Madeleine De Block, Merchtem; Bruno Albert Jean Hubesch, Leefdaal, all of Belgium

[73] Assignee: The Procter & Gamble Company, Cincinnatti, Ohio

[21] Appl. No.: 09/155,776

[22] PCT Filed: Mar. 27, 1997

[86] PCT No.: PCT/US97/05107

§ 371 Date: Mar. 2, 1999

§ 102(e) Date: Mar. 2, 1999

[87] PCT Pub. No.: WO97/36981

PCT Pub. Date: Oct. 9, 1997

[30] Foreign Application Priority Data

Apr. 1, 1996 [EP] European Pat. Off. ..... 96870041

[51] Int. Cl.[7] ..... C11D 1/645; C11D 3/30; C11D 3/36; C11D 3/37

[52] U.S. Cl. ..... 510/527; 510/475

[58] Field of Search ..... 510/515, 488, 510/490, 504, 477, 479, 480, 475, 476, 527

[56] References Cited

U.S. PATENT DOCUMENTS

| | | | |
|---|---|---|---|
| 3,936,537 | 2/1976 | Baskerville, Jr. et al. | 427/242 |
| 4,438,095 | 3/1984 | Grollier et al. | 424/70 |
| 4,702,857 | 10/1987 | Gosselink | 252/174.21 |
| 4,871,467 | 10/1989 | Akred et al. | 252/135 |
| 5,147,576 | 9/1992 | Montague et al. | 252/174 |
| 5,405,412 | 4/1995 | Willey et al. | 8/111 |
| 5,429,754 | 7/1995 | Lin et al. | 252/8.6 |
| 5,474,690 | 12/1995 | Wahl et al. | 252/8.8 |
| 5,585,034 | 12/1996 | Lysy et al. | 510/403 |
| 5,633,223 | 5/1997 | Vasudevan et al. | 510/303 |
| 5,686,376 | 11/1997 | Rusche et al. | 502/329 |
| 5,698,183 | 12/1997 | Langer et al. | 424/59 |
| 5,767,052 | 6/1998 | Shaw, Jr. et al. | 510/329 |

FOREIGN PATENT DOCUMENTS

| | | | |
|---|---|---|---|
| 079646 A2 | 5/1983 | European Pat. Off. . | |
| 0 126 528 | 11/1984 | European Pat. Off. | C08F 2/32 |
| 0 172 723 | 2/1986 | European Pat. Off. | C08F 246/00 |
| 0 309 052 | 3/1989 | European Pat. Off. | C11D 1/835 |
| 0 385 789 | 9/1990 | European Pat. Off. | B01J 8/24 |
| 0 422 179 | 4/1991 | European Pat. Off. | C11D 3/37 |
| WO 90/12862 | 11/1990 | WIPO . | |

*Primary Examiner*—Yogendra Gupta
*Assistant Examiner*—John R. Hardee
*Attorney, Agent, or Firm*—Jason J. Camp; Robert B. Aylor

[57] ABSTRACT

A liquid fabric softening composition comprising a) from 0.01% to 10% by weight of a fabric softener component; b) at least 0.001% of a thickening agent selected from the group consisting of I) associative polymers having a hydrophilic backbone and at least two hydrophilic groups per molecule attached to the hydrophilic backbone; ii) cross-linked cationic polymers that are derivable from a water-soluble cationic ethylenically unsaturated monomer or blend of monomers which is cross-linked by 5 to 45 ppm of a cross-linking agent comprising polyethylenic functions; and iii) mixtures thereof; c) a component capable of sequestering metal ions and selected from the group consisting of: aminocarboxylic acids, organo aminophosphonic acids, and mixtures thereof.

13 Claims, No Drawings

FABRIC SOFTENER COMPOSITIONS

FIELD OF THE INVENTION

The present invention relates to fabric softening compositions showing excellent stability upon storage. More particularly, it relates to liquid fabric softening compositions.

BACKGROUND OF THE INVENTION

Fabric softening compositions, in particular fabric softening compositions to be used in the rinse cycle of laundry washing processes, are well-known to the consumer to provide fabrics with a soft and agreeable feeling. Such compositions are provided in two forms: concentrated compositions comprising more than 10% by weight of fabric softening agents and diluted compositions comprising less than 10% by weight of fabric softening agents.

Nevertheless, consumer acceptance of such compositions is determined not only by the performance achieved with these products but also by the aesthetics associated therewith. Viscosity of the product is therefore an important aspect of the successful formulation of such commercial products; stable medium to medium-high viscosities being highly preferred by consumer. By medium-high viscosities, it is meant viscosities of 50 cps to 150 cps when the fabric softening composition is in a diluted form and viscosities of 30 cps to 90 cps when the fabric softening composition is in a concentrated form.

However, a problem encountered with diluted compositions is that, contrary to concentrated compositions which exhibit a "self-building viscosity" due to their high amount of active, diluted compositions show a phase instability as well as a viscosity problem. Such a problem can be encountered either with an already-made diluted product or with a concentrated product as it is diluted.

To this end, thickeners such as compounds of the polyacrylamide, polysacharide or polyurethanes type have been widely used in such compositions. Disclosure of such compounds may be found in EP 0,422,179 and EP 0,309,052. However, a problem encountered with such thickeners is the necessity for them to be present at high levels to provide effective thickening effect. Whilst the use of such high levels would provide a good remedy to the problem, this would increase the formulation cost.

Compounds of the associative polymeric type or cross-linked cationic polymeric type are effective as thickeners, even at low levels. Disclosure of such compounds may be found in EP 0,385,789 and EP 0,422,179. However, the use of such compounds has been found to be detrimental to the phase stability and viscosity performance of the product upon storage and thus to the fabric softening performance of the product.

Not to be bound by theory, it is believed that such compounds are provided with anionic charges which destabilise the formulation equilibrium.

The potential for such a problem is enhanced when the softening composition comprises electrolytes.

The Applicant has now found that the addition of a component capable of sequestering metal ions, preferably in specific amounts, overcomes the problem.

By thickener is meant a component which has thickening properties, that is a compound which, when incorporated in a fabric softening composition, produces compositions with a higher viscosity in the presence of the polymer than in the absence of the polymer. Not included within the scope of this term are components having soil release properties such as those defined in U.S. Pat. No. 4,702,857.

It is therefore an advantage of the invention to provide compositions with good phase stability and viscosity.

It is another advantage of the invention to provide softening compositions with an effective softness performance.

It is a further advantage of the invention to provide softening compositions which allow the use of electrolytes without being detrimental to the formulation equilibrate.

SUMMARY OF THE INVENTION

The present invention relates to a liquid fabric softening composition comprising:

a) from 0.01% to 10% by weight of a fabric softener component, b) at least 0.001% of a thickening agent selected from the group consisting of:
   - i) associative polymers having a hydrophilic backbone and at least two hydrophobic groups per molecule attached to the hydrophilic backbone,
   - ii) cross-linked cationic polymers that are derivable from a water-soluble cationic ethylenically unsaturated monomer or blend of monomers which is cross-linked by 5 to 45 ppm of a cross-linking agent comprising polyethylenic functions, and
   - iii) mixtures thereof, c) a component capable of sequestering metal ions and selected from the group consisting of:
   - i) chelating components selected from the group consisting of amino carboxylic acid, organo aminophosphonic acid components, and mixtures thereof,
   - ii) polycarboxylic building components, other than those defined under i) as chelating components, comprising at least two carboxylic radicals separated from each other by not more than two carbon atoms, and,
   - iii) mixtures thereof.

DETAILED DESCRIPTION OF THE INVENTION

Fabric Softeners

An essential component of the invention is a fabric softener component. The fabric softening materials may be selected from the group consisting of cationic, nonionic, amphoteric or anionic fabric softening material.

The fabric softener components herein are present at levels of from 0.01% to 10% by weight, with a preferred level of fabric softening components from 1% to 5% by weight of the composition.

Typically, such compositions contain a water-insoluble quaternary-ammonium fabric softening active, the most commonly used having been di-long alkyl chain ammonium chloride.

In recent years, the need has arisen for more environmentally-friendly materials, and rapidly biodegradable quaternary ammonium compounds have been presented as alternatives to the traditionally used di-long chain ammonium chlorides. Such quaternary ammonium compounds contain long chain alk(en)yl groups interrupted by functional groups such as carboxy groups. Said materials and fabric softening compositions containing them are disclosed in numerous publications such as EPA 040 562, and EPA 239 910.

The quaternary ammonium compounds and amine precursors herein have the formula (I) or (II), below:

(I)

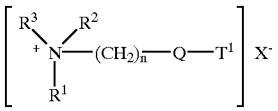

or (II)

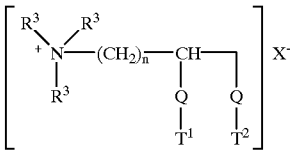

Q is selected from the group consisting of —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium chloride;
3) N,N-di(2-tallowyl-oxy-2-oxo-ethyl)-N,N-dimethyl ammonium chloride;
4) N,N-di(2-tallowyl-oxy-ethylcarbonyloxyethyl)-N,N-dimethyl ammonium chloride;
5) N-(2-tallowyl-oxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxoethyl)-N-(tallowyl-N,N-dimethyl-ammonium chloride); and
8) 1,2-ditallowyl-oxy-3-trimethylammoniopropane chloride; and mixtures of any of the above materials.

Of these, compounds 1–7 are examples of compounds of Formula (I); compound 8 is a compound of Formula (II).

Particularly preferred is N,N-di(tallowyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion. By "amine precursors thereof" is meant the secondary or tertiary amines corresponding to the above quaternary ammonium compounds, said amines being substantially protonated in the present compositions due to the claimed pH values.

For the preceding biodegradable fabric softening agents, the pH of the compositions herein is an essential parameter of the present invention. Indeed, it influences the stability of the quaternary ammonium or amine precursors compounds, especially in prolonged storage conditions.

The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a diluted form, the pH of the neat composition is in the range of 2.0 to 3.0. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Other fabric softening materials may be used in addition or alternatively to the biodegradable fabric softener. These may be selected from the group consisting of cationic fabric softening materials such as di-long alkyl chain ammonium chloride, nonionic, amphoteric or anionic fabric softening materials. Disclosure of such materials may be found in U.S. Pat. Nos. 4,327,133; 4,421,792; 4,426,299; 4,460,485; 3,644,203 and 4,661,269.

Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc. The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Thickening Agent

The second essential component of the invention is a thickening agent. Typical levels of such a thickener is of at least 0.001%, preferably from 0.001 to 3%, more preferably from 0.01% to 1% and most preferably from 0.1% to 0.5% by weight of the composition.

Suitable thickening agents are selected from the group consisting of associative polymers having a hydrophilic backbone and at least two hydrophobic groups per molecule attached to the hydrophilic backbone, cross-linked cationic polymers that are derivable from a water-soluble cationic ethylenically unsaturated monomer or blend of monomers which is cross-linked by 5 to 45 ppm of a cross-linking agent comprising polyethylenic functions, and mixtures thereof.

Associative Polymers Having a Hydrophilic Backbone and at Least Two Hydrophobic Groups per Molecule Attached to the Hydrophilic Backbone It is believed that for associative polymers only polymeric molecules having at least two hydrophobic moieties contribute to the thickening effect. However, for practical purposes, generally, a reaction mixture of polymeric molecules will be used, in that case it is not necessary that in such a mixture the molecules contain on average two hydrophobic moieties; satisfactory results can also be obtained when the average is less than two, provided that a significant part of the molecules comprise two or more hydrophobic moieties. It is however preferred that polymeric reaction mixtures are used which comprise on average two or more hydrophobic moieties per molecule.

The polymeric thickeners for use in fabric softener compositions according to the invention preferably have a nonionic or cationic hydrophilic backbone. Preferably the polymeric thickeners are hydrophobically modified nonionic polymers.

Preferred hydrophobically modified nonionic polymers are based on polyoxyalkylene or polyvinylalcohol hydrophilic backbones, to which a small number of alkyl groups have been attached. Examples of these materials are:

(i) copolymers of ethylene oxide and/or propylene oxide with small amounts of $C_8$–$C_{24}$ side chains, for instance having the basic formula:

$$[R_4]_{(4-x)}—C—[CH_2O—(CH(R_5)—CH_2O)y—CH(R_6)—CH(R_7)OH]_x$$

wherein each $R_4$, independently, is a $C_1$–$C_4$ alkyl group, preferably a $C_2$ alkyl group;

wherein each $R_5$, independently, is hydrogen or a methyl group;

wherein each $R_6$, $R_7$, independently, is selected from the group consisting of H, a $C_8$–$C_{24}$ alkyl group and a a $C_8$–$C_{24}$ alkyl containing group, preferably a $C_{16}$ alkyl group or a $C_{16}$ alkyl containing group; with the proviso that for each chain, one of $R_6$ or $R_7$ is H and the other $R_6$ or $R_7$ is a $C_8$–$C_{24}$ alkyl group and a a $C_8$–$C_{24}$ alkyl containing group, preferably a $C_{16}$ alkyl group or a $C_{16}$ alkyl containing group.

wherein y is an integer lying in the range of from 20 to 1000, preferably in the range of from 50 to 500, more preferably in the range of from 200 to 400;

wherein x is an integer lying in the range from 2 to 4 and preferably has the value of 3.

Preferably, the above associative thickener has hydrophobic groups constituting less than 10% by weight, preferably less than 6% by weight of the polymeric material.

The associative thickeners of formula i) can be prepared by first reacting ethylene oxide or propylene oxide and generally one lower alkylene oxide with at least one active hydrogen-containing compound containing at least one active hydrogen and subsequently or simultaneously reacting therewith at least one long chain aliphatic alpha-olefin oxide or glycidyl ether. Said long chain oxide or glycidyl ether has a carbon chain length of 8 to 24 aliphatic carbon atoms, preferably 12 to 18 carbon atoms. The proportion of said alpha-olefin oxide or glycidyl ether present in the polyether thickener is 1 to 20% by weight, based upon the total weight of the thickener.

Suitable active hydrogen-containing compound containing at least one active hydrogen include monohydric and polyhydric alcohol initiators. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing 12 to 18 carbon atoms in the aliphatic or alkyl group. In addition, aliphatic mercaptans having 12 to 18 carbon atoms are useful initiators.

A preferred example of thickener is the associative polymer of formula i), whereby said thickener is a polymer with a central part made of polyalkylene oxide chains (80% ethylene oxide and 15% propylene oxide) on which 5% hydrophobic chains (1,2-epoxyhexadecane) are branched.

Most preferably, the thickener of formula i) is mixed with an ethoxylated surfactant. In this case, the ethoxylated alcohols can vary in chainlength and degree of ethoxylation or any mixtures thereof. A preferred example of ethoxylated surfactant is Lutensol T08™, a $C_{13}$ ethoxylated alcohol with an average ethoxylation grade of 8, available from BASF. The thickener of formula i) and the ethoxylated surfactant are preferably present in a ratio of polymer to Lutensol T08™ of 25:75.

A preferred example for preparing said thickener is as follows:

A liquid copolymer contaning 80% by weight of the residue of ethylene oxide, 15% by weight of the residue of 1,2-propylene oxide and 5% by weight of the residue of an alpha-olefin oxide having an aliphatic carbon chain length of 15 to 18 carbon atoms was prepared according to the following procedure. A polyether derived from ethylene oxide and 1,2-propylene oxide in the weight ratio of 75% ethylene oxide and 25% 1,2-propylene oxide was prepared by reaction with trimethylolpropane in two stages in a stainless steel auto clave. A first intermediate product was prepared by reacting a mixture of trimethylol, potassium hydroxide, 1,2-propylene oxide, and ethylene oxide for a period of 18 hours at 120° C. The final product was prepared in a second stage by reacting the previously prepared intermediate with a mixture of 1,2-propylene oxide and ethylene oxide under a nitrogent atmosphere of 115° for 22 hours. The product had a molecular weight of 23,000.

A glass flask was charged with 1410 grams of the final polyether product prepared above and heated to 105° C. while maintaining a nitrogen atmosphere. There was then added with stirring 10.2 grams of sodium and the mixture reacted for a period of 24 hours. The intermediate product obtained thereby was cooled to room temperature prior to further use.

Thereafter, a 250 ml centrifuge bottle was charged with 100 grams of this intermediate product together with 3.3 grams of 1,2-propylene oxide and 19 grams of ethylene oxide. The contents of the bottle were mixed at room temperature and after the bottle was stoppered with a rubber stopper, the bottle was placed in a steam bath for 24 hours. This product was cooled to room temperature before further use. To the centrifuge bottle containing this product, there was added 2.5 grams of an alpha-olefin oxide having an aliphatic carbon chain length of 15 to 18 carbon atoms together with 3.3 grams of 1,2-propylene oxide and 19 grams of ethylene oxide. The contents of the bottle were further mixed and the bottle was stoppered and placed in a steam bath for 21 hours after which a viscous product was obtained.

(ii) copolymers of ethylene oxide and/or propylene oxide with small amounts of $C_8$–$C_{24}$ side chains, for instance having the basic formula:

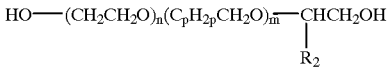

wherein the group—$(CH_2CH_2O)_n$ $(C_pH_{2p}CH_2O)_m$—is substituted by a minimum of two $R_1$ groups which can be substituted at any $CH_2$ group along the polymer backbone;

(iii) Hydrophobically modified poly (ethylene oxide and/or propylene oxide/urethanes) for instance of the following formula:

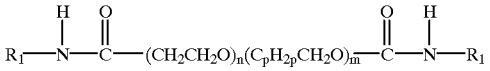

wherein the group—$(CH_2CH_2O)_n$ $(C_pH_{2p}CH_2O)_m$—is substituted by a minimum of two $R_1$ groups which can be substituted at any $CH_2$ group along the polymer backbone; and (iv) alkyl substituted poly (vinyl) alcohols, for instance of the following formula:

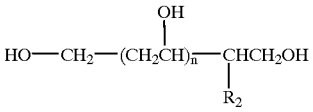

wherein the group—$(CH_2CHOH)_n$—is substituted by a minimum of two $R_1$ groups which can be substituted at any $CH_2$ group along the polymer backbone; and Wherein for formula (ii) to (iv):

n=greater than 10 p=1 to 4 preferably 1 or 2 n+m=greater than 10 m=if p is greater than 1, m is such that the group involved constitutes less than 50 mole %, preferably less than 25 mole % of the polymer.

$R_1$=a $C_8$–$C_{24}$ linear or branched alkyl or alkenyl $R_2$=hydrogen or a $C_8$–$C_{24}$ linear or branched alkyl or alkenyl $R_3$=a minimum of two $R_1$ groups which can be substituted at any $CH_2$ group along the polymer backbone.

Hydrophobically modified poly (ethylene oxide and/or propylene oxide/urethanes) according to formula (iii) are marketed by UNION CARBIDE under the UCAR SCT trademark for the thickening of latex systems and generally have a molecular weight in the region of 40.000.

Preferably for the compounds of formula (ii) to (iv) the number of hydrophobic groups attached to the hydrophilic backbone is relatively small. Preferably, the hydrophobic groups constitute less than 5% by weight of the polymer, more preferably between 0.5 and 2% by weight of the polymer. Preferred hydrophobic groups are linear or branched alkyl or alkenyl groups, preferably having a chain length of less than 40, more preferably between 8 and 24 carbon atoms.

Other preferred hydrophobically modified nonionic polymers based on polyoxyalkylene hydrophilic backbones, to which a small number of alkyl groups have been attached are the hydrophobically modified polyacrylic acid polymers such as the polyalkyl acrylic acid sold under the tradenames Viscalex, Rheovis CRX, Rheovis CR, Rheovis CR2 available from Allied Colloid, Acusol 810, Acusol 820, Acusol 823, Acusol 830, Acusol 842 available from Rohm & Haas.

The preferred molecular weight of the above mentionned thickener materials to be used is preferably above 10,000 more preferred from 10,000 to 1,000,000 more preferred from 15,000 to 100,000, especially preferred from 20,000 to 70,000.

Cross-linked Cationic Polymers that are Derivable from a Water-soluble Cationic Ethylenically Unsaturated Monomer or Blend of Monomers which is Cross-linked by 5 to 45 ppm of a Cross-linking Agent Comprising Polyethylenic Functions The cross-linked, cationic polymers, (hereafter "CP"), are formed from monoethylenically unsaturated monomer that is either a water soluble cationic monomer or is a cationic blend of monomers that may consist of cationic monomers alone or may consist of a mixture of cationic and non-ionic monomers in the presence of a cross-linking agent. If a blend of monomers is being used, then part of the blend may have a low water solubility, providing the blend is water soluble. The monomers can be allyl monomers but are generally vinyl, preferably acrylic.

Suitably, the cationic polymers are derivable from cationic monomers comprising one or more of (a) dialkylaminoalkyl-acrylates or methacrylates, (b) dialkylaminoalkyl-acrylamides or methacrylamides and (c) the quaternary or acid salts of (a) or (b), for instance methacrylamidopropyl tremethyl ammonium chloride and Mannich products such as quaternised dialkylaminomethylacrylamides. Alkyl groups are generally $C_{1-4}$ alkyl.

Suitable non-ionic monomers are acrylamide, methacrylamide, N-vinyl pyrrolidone, and lower alkyl water insoluble acrylic (or other ethylenically unsaturated) monomers such as methyl methacrylate, styrene or acryloniltrile which may be included in sufficiently small amounts so that the blend is soluble.

Blends of 5–90%, preferably 5–50%, acrylamide with dialkylaminoalkyl-acrylate or, preferably-methacrylate as acid addition or quaternary addition salts, or, cationic homopolymers (containing no acrylyamide groups) are preferred.

The monomers can contain hydrophobic groups, e.g. as described in EP-A-0,172,723, for instance on page 10 of that specification. If the monomer is to impart insolubility to the polymer, ethoxy chains, if any, should be short or absent, i.e., n=0. The allyl ether monomers are especially preferred.

The cationic polymer must be added while in the form of particles below 10 micrometers in size, and preferably below 2 micrometers in size. These can be made by comminuting a cross-linked polymer gel but preferably the particles are formed initially in the cross-linked state. The particles may be added to the aqueous solution as disintegratable aggregates or pellets, but preferably are added as dispersion in a liquid, generally a non-aqueous liquid such as a hydrocarbon. This dispersion may be made by dispersing preformed particles in the liquid but is preferably made by reverse phase polymerisation of the monomer or monomer blend in the presence of the cross linker.

The monoethylenically unsaturated starting material may be contaminated with a small amount of crosslinking agent and the amount of additional cross-linking agent that is added will therefore be selected having regard to this. Preferably the monoethylenically unsaturated material is as free of cross-linking agent as is commercially possible, for instance containing cross-linking agent in an amount that gives cross-linking or chain branching less than is given by e.g. 1 ppm of a cross-linking agent comprising polyethylenic functions used in the present invention. By the term "polyethylenic functions" as used herein and throughout the specification is meant cross-linking agents which have two or more ethylenically unsaturated groups per molecule of the agent. Thus, an example of such an agent is methylene bisacrylamide (hereafter "MBA"). The amount of cross-linking agent with polyethylenic functions e.g. MBA that is added is at least 5 ppm and upto 45 ppm (based on monomer), generally from 10 to 40 ppm. The precise amount will depend upon the polymerisation and other processing conditions. Instead of using MBA, cross-linking may be equally achieved by using effective amounts of other diethylenically unsaturated compounds such as ethylene glycol di-acrylate, diacrylamide, cyanomethylacrylate, vinyloxyethylacrylate or methacrylate and other means of cross linking, e.g. formaldehyde or glyoxal or metal salt addition. Preferably a water-soluble cross-linking agent is used.

The degree of non-linearity can additionally be controlled by the inclusion of chain transfer agents in the polymerisation mixture. Their use, in combination with cross-linking agent, will tend to promote chain branching rather than cross linking. Amounts may vary widely. For instance 1000 to 5000 ppm (based on monomer) of a moderate chain transfer agent such as isopropyl alcohol may be suitable whilst much lower amounts, typically 100 to 500 ppm, of more effective chain branching agents such as mercaptoethanol are useful. Often, however, adequate results are obtained by conducting polymerisation under conventional conditions without deliberate addition of chain transfer agents using commercially pure monoethylenically unsaturated monomer together with the specified amount of MBA or other cross-linking agent.

Preferred CP's are often formed with up to 40% w/w acrylamide and 100 to 60% w/w dialkylaminoethyl methacrylate quaternary salt (for instance 20% acrylamide 80% dimethylaminoethyl methacrylate quaternary salt) cross linked with 10 to 40 ppm, preferably 10–30 ppm of MBA or other cross linker. All parts and percentages are by weight. The precise optimum for any particular composition can be determined by observing the properties of the composition when thickened with the chosen amount of a range of CP's differing from one another solely by differing the amounts of MBA from 5 to 45 ppm.

The polymerisation conditions are preferably such that the polymer has, if uncross-linked, a notional high molecular weight of 5 million to 30 million and an intrinsic viscosity (hereafter IV) of above 4, preferably above 6, e.g., up to 10 or 15 dl/g. If the polymer is cross linked (CP) it is preferably polymerised such that it would have such molecular weight if it had been made in the absence of cross linking agent. However, cross linking will reduce the IV but the shearing may then cause the IV to increase, as explained below.

The particle size in the emulsion of reverse phase polymerisation mixture may be controlled by the degree of shear applied to the monomers and by the possible presence of emulsifying agent. Emulsion polymerisation may be utilised when polymerising, for instance, water insoluble monomers such as acrylic esters or water insoluble but acid soluble monomers such as amines (the resultant CP being distributed into acidic aqueous composition) but generally reverse phase emulsion or suspension polymerisation is utilised when the monomer or monomer blend is soluble in water. The aqueous monomer is emulsified into a suitable non-aqueous liquid, generally in the presence of a water in oil emulsifier, generally in an amount below the critical micelle concentration. Emulsifiers, stabilisers, non-aqueous liquids and other reverse phase polymerisation materials and process details are described in, for instance, EP-A-0,126,528. The CP particles may be dehydrated, for instance by subjecting the dispersion to azeotropic distillation.

The liquid product from the reverse phase polymerisation or emulsion polymerisation is generally used as such, without separation of the polymer particles from it, but if desired dried polymer particles may be separated from the dispersion in known manner. Because these dry particles will be very dusty they should preferably be formed into pellets that will disintegrate upon addition to water.

The polymer-in-oil emulsion that results from reverse phase polymerisation may be added to the composition to be thickened in the presence of oil-in-water emulsifier in conventional manner.

When the polymeric material is cross linked and cationic, and in particular when it is a copolymer of acrylamide with at least 5%, and preferably at least 10%, by weight dialkylamino alkyl acrylate (generally as acid addition or quaternary ammonium salt) the degree of non-linearity is preferably such that the CP has an ionic regain (IR) of at least 15%. IR is calculated as (x-y/x)100 where x is the ionicity measured after applying standard shear and y is the ionicity of the polymer before applying standard shear.

These values are best determined by forming a 1% composition of the CP in deionised water, allowing this to age for 2 hours and then further diluting it to 0.1% active CP. The ionicity of the CP, y, is measured by Colloid Titration as described by Koch-Light Laboratories Limited in their publication 4/77 KLCD-1.

(Alternatively the method described in GB-A-1,579,007 could possibly be used to determine y). The ionicity after shear, x, is determined by measuring by the same technique the ionicity of this solution after subjecting it to standard shear.

The shear is best applied to 200 ml of the solution in a substantially cylindrical pot having a diameter of about 8 cm and provided in its base with a rotatable blade about 6 cm in diameter, one arm of the blade pointing upwards by about 45 degrees and the other downwards by about 45 degrees. The blade is about 1 mm thick and is rotated at 16,500 rpm in the base of the pot for 10 minutes. These conditions are best provided by the use of a Moulinex homogeniser but other satisfactory conditions can be provided using kitchen blenders such as Kenwood, Hamilton Beach, Iona or Osterizer blenders of a Waring Blender.

In practice, the precise conditions of shear are relatively unimportant since, provided the degree of shear is of the same order of magnitude as specified, it will be found that IR is not greatly affected by quite large changes in the amount, for instance the duration of shear, whereas at lower amounts of shear (for instance 1 minute at 16,500 rpm) IR is greatly affected by small changes in shear. Conveniently therefore the value of x is determined at the time when, with a high speed blade, further shear provides little or no further change in ionicity. This generally requires shearing for 10 minutes, but sometimes longer periods, e.g., up to 30 minutes with cooling, may be desired.

The CP's used in the invention preferably have IR above 30%, often in the range 35 to 45%. IR may increase from zero at zero cross linker up to peak or plateau at a level around, for instance 10 to 25 ppm, cross linker and preferably IR is at or near this peak or plateau, generally at as low a level of cross linking as is consistent with the high IR value.

A preferred example of a cross-linked polymer is as follows: A reversed phase dispersion was formed by dispersing into a conventional reverse phase non-aqueous liquid containing emulsifying agent and amphiphatic stabiliser an aqueous monomer blend consisting of 80% by weight dimethylaminoethyl methacrylate methyl chloride quaternary salt and 20% acrylamide and 15 ppm methylene bis acrylamide. The mixture was degassed and initiated in the conventional manner and polymerisation was allowed to go to completion. The mixture was then subjected to azeotropic distillation to provide a substantially anhydrous dispersion of polymer particles less than 2 micrometers in size dispersed in mineral oil (50% w/w) which was Shell oil 60 Solvent Pale.

A preferred commercially representative of a cross-linked cationic polymer is BP 705™ ex BP Chemicals.

Component Capable of Sequestering Metal Ions

A third essential component of the invention is a component capable of sequestering properties, that is a component which acts to sequester (chelate) metal ions. Such compound may be selected from the group consisting of a chelating component, a polycarboxylic building component and mixtures thereof.

A. Chelating Components

Chelating components are present at a level of at least 0.001% (10 ppm), preferably in amount from 0.001% (10 ppm) to 0.5%, more preferably from 0.005% to 0.25%, most preferably from 0.01% to 0.1% by weight of the composition.

Suitable chelating components for use in the present invention are selected from the group consisting of amino carboxylic acid, organo aminophosphonic acid compounds, and mixture thereof.

Chelating components, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the chelating component is preferably at least 1:1.

Suitable chelating components for use herein include the amino carboxylic acids such as ethylenediamine-N,N'-disuccinic acid (EDDS), ethylenediamine tetraacetic acid (EDTA), N-hydroxyethylenediamine triacetic acid, nitrilotriacetic acid (NTA), ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid (DETPA), trans 1,2 diaminocyclohexane-N,N,N',N'-tetraacetic acid or ethanoldiglycine.

Other suitable chelating components for use herein include the organo aminophosphonic acids such as ethylenediamine tetrakis (methylenephosphonic acid), diethylene triamine-N,N,N',N", N"-pentakis (methylene phosphonic acid) (DETMP), 1-hydroxyethane 1,1-diphosphonic acid (HEDP) or hydroxyethane dimethylenephosphonic acid.

Mixture of any of the herein before described chelating components can also be used.

Especially preferred is ethylenediamine-N,N'-disuccinic acid (EDDS), most preferably present in the form of its S,S isomer, which is preferred for its biodegradability profile.

B Polycarboxylic Building Components

Polycarboxylic building components are present at a level of at least 0.01% (10 ppm), typically at a level of at least 0.045% (450 ppm), preferably at a level of from 0.045% to 0.5%, more preferably from 0.09% to 0.25%, most preferably from 0.1% to 0.2% by weight of the composition.

Suitable polycarboxylic building components for use herein can be monomeric or oligomeric in type although monomeric polycarboxylates are generally preferred for reasons of cost and performance.

Polycarboxylic acids containing two carboxy groups include succinic acid, malonic acid, (ethylenedioxy) diacetic acid, maleic acid, diglycolic acid, tartaric acid, tartronic acid and fumaric acid, as well as the ether carboxylic acid and the sulfinyl carboxylic acids. Polycarboxylic acids containing three carboxy groups include, in particular, citric acid, aconitric and citraconic as well as succinic derivatives such as the carboxymethyloxysuccinic described in British Patent No. 1,379,241, lactoxysuccinic described in British Patent No. 1,389,732, and aminosuccinic described in Netherlands Application 7205873, and the oxypolycarboxylic materials such as 2-oxa-1,1,3-propane tricarboxylic described in British Patent No. 1,387,447.

Polycarboxylic containing four carboxy groups include oxydisuccinic disclosed in British Patent No. 1,261,829, 1,1,2,2-ethane tetracarboxylic, 1,1,3,3-propane tetracarboxylic and 1,1,2,3-propane tetracarboxylic. Polycarboxylic containing sulfo substituents include the sulfosuccinate derivatives disclosed in British Patent Nos. 1,398,421 and 1,398,422 and in U.S. Pat. No. 3,936,448, and the sulfonated pyrolysed citric described in British Patent No. 1,439,000.

Alicyclic and heterocyclic polycarboxylic include cyclopentane-cis,cis,cis-tetracarboxylic, cyclopentadienide pentacarboxylic, 2,3,4,5-tetrahydrofuran-cis, cis, cis-tetracarboxylic, 2,5-tetrahydrofuran-cis-dicarboxylic, 2,2,5,5-tetrahydrofuran-tetracarboxylic, 1,2,3,4,5,6-hexane-hexacarboxylic and carboxymethyl derivatives of polyhydric alcohols such as sorbitol, mannitol and xylitol. Aromatic polycarboxylic include mellitic acid, pyromellitic acid and the phthalic acid derivatives disclosed in British Patent No. 1,425,343. Although suitable for use, citric acid is less preferred for the purpose of the invention.

Of the above, the preferred polycarboxylic are carboxylic containing up to three carboxy groups per molecule, more particularly maleic acid.

Another ingredient of the invention is a liquid carrier. Suitable liquid carriers for the present invention are selected from the group consisting of water, organic solvents and mixtures thereof. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Optional Components

Surfactant Concentration Aids

Surfactant concentration aids may also optionally be used. Surfactant concentration aids are typically selected from the group consisting of single long chain alkyl cationic surfactants, nonionic surfactants, amine oxides, fatty acids, and mixtures thereof, typically used at a level of from 0 to 15% of the composition.

Single Long Chain Alkyl Cationic Surfactants

Such mono-long-chain-alkyl cationic surfactants useful in the present invention are, preferably, quaternary ammonium salts of the general formula:

$$[R^2N{+}R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from 0.1% to 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

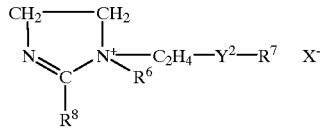

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from the group consisting of R and $R^2$ as defined hereinbefore for the single-long-chain cationic surfactant with only one being $R^2$.

Some alkyl pyridinium salts useful in the present invention have the general formula:

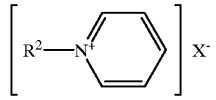

wherein $R^2$ and X– are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from 7 to 20, preferably from 8 to 15.

Examples of particularly suitable nonionic surfactants include

- Straight-Chain, Primary Alcohol Alkoxylates such as tallow alcohol-EO(11), tallow alcohol-EO(18), and tallow alcohol-EO(25);
- Straight-Chain, Secondary Alcohol Alkoxylates such as 2-$C_{16}$EO(11); 2-$C_{20}$EO(11); and 2-$C_{16}$EO(14);
- Alkyl Phenol Alkoxylates, such as p-tridecylphenol EO(11) and p-pentadecylphenol EO(18), as well as
- Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from the group consisting of alkyl groups and hydroxyalkyl groups with 1 to 3 carbon atoms.

Examples include dimethyloctylamine oxide, diethyidecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 15 to 17 (mid cut), carbon atoms.

Electrolyte Concentration Aids

The composition of the invention may also optionally comprise one or more electrolytes. It has been found that where electrolytes concentration aids were added to diluted softening compositions comprising thickeners but no sequestering component, the problem of phase and viscosity instability upon storage was increased. Surprisingly, compositions according to the invention allow the use of electrolytes concentration aids and still exhibit excellent phase and viscosity stability upon storage.

Electrolyte concentration aids, e.g. inorganic viscosity control agents, which can also act like or augment the effect of the surfactant concentration aids, include water-soluble, ionizable salts. These inorganic viscosity control agents can also optionally be incorporated into the compositions of the present invention. Incorporation of these components to the composition must be processed at a very slow rate. A wide variety of ionizable salts can be used. Examples of suitable salts are the halides of the Group IA and IIA metals of the Periodic Table of the Elements, e.g., potassium chloride, calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilise the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

Still other optional ingredients are stabilisers, such as well-known antioxidants and reductive agents, Soil Release Polymers, emulsifiers, bacteriocides, colorants, perfumes, preservatives, optical brighteners, anti ionisation agents, antifoam agents and enzymes.

Optionally, sensitive ingredients such as perfumes or enzymes can be isolated from their hostile environment by reversibly absorbing said compounds into a porous hydrophobic material. In this way, the porous hydrophobic material serves as a "cage" wherein the sensitive ingredient is enclosed. Subsequently, the pores of the filled hydrophobic porous material are sealed by dispersing said porous material into a hydrophobic liquid.

By sealing the pores of the hydrophobic material, the hydrophobic liquid acts as a "shell", thereby protecting the sensitive ingredient from its environment, reducing the loss of activity which could be encountered in hostile environment and without reducing the ability of the sensitive ingredient to perform its normal function. Exemplary disclosure of this "shell and cage" system can be found in EP-A-0,583,512.

The invention is illustrated in the following non-limiting examples, in which all percentages are on a weight basis unless otherwise stated.

EXAMPLE 1

The following prior art fabric softening compositions 1 and 2 were prepared

| | Composition 1 | Composition 2 |
|---|---|---|
| DEQA (1) | 20 | 18 |
| Hydrochloric acid | 0.02 | 0.02 |
| Fatty acid (2) | — | 1.0 |
| Perfume | 1.0 | — |
| Electrolyte (3) | 0.20 | 0.06 |
| Silicon antifoam | 0.01 | 0.01 |
| Dye | 0.005 | — |
| Polyethylene Glycol 4000 | 1.0 | 0.60 |
| Water and minors to balance to 100 | | |

(1) Di-(taliowyloxyethyl) dimethyl ammonium chloride
(2) Stearic acid IV=0
(3) Calcium chloride These compositions were made according to a known process for preparing fabric softener compositions, e.g by injection into the hot water seat (60°–70°) containing minors the molten DEQA, followed by slowly adding the electrolyte to the desired viscosity and thereafter the perfume before leaving the product to cool.

The product of composition 1 was thereafter diluted 4 times and a thickener as defined below under (5) was added while the product of composition 2 was diluted 2 times and the thickener BP7050™ ex BP Chemicals was added. The resulting diluted fabric softener composition exhibited excellent viscosity and phase stability on a freshly made product as well as upon storage.

The diluted formulations were as follows:

| | Composition 3 | Composition 4 |
|---|---|---|
| Composition 1 | 25 | 50 |
| Hydrochloric acid | — | — |
| maleic acid | 1200 ppm | — |
| DETMP (4) | — | 750 ppm |
| thickener (5) | 0.25 | — |
| BP7050 ™ (6) | — | 0.3 |
| Dye | — | 7.5 ppm |
| perfume | — | 2.0 |
| Water | up to 100 | up to 100 |

(4) diethylene triamine-N,N,N',N",N"-pentakis (methylene phosphonic acid)

(5) copolymers of ethylene oxide and/or propylene oxide with small amounts of $C_8$–$C_{24}$ side chains as defined herein before with a central part made of polyalkylene oxide chains (80% ethylene oxide and 15% propylene oxide) on which 5% hydrophobic chains (1,2-epoxyhexadecane) are branched, said copolymer being mixed with Lutensol T08™ in a ratio of copolymer to Lutensol T08™ of 25:75.

(6) BP7050™ ex BP Chemicals

What is claimed is:

1. A liquid fabric softening composition having a pH of from 2.0 to 3, comprising:

a) from 0.01% to 10% by weight of a cationic fabric softener component, b) at least 0.001% of a thickening agent selected from the group consisting of:

i) associative polymers having a hydrophilic backbone and at least two hydrophobic groups per molecule attached to the hydrophlic backbone, ii) cross-linked cationic polymers that are derivable from a water-soluble cationic ethylenically unsaturated monomer or blend of monomers which is cross-inked by 5 to 45 ppm of a cross-linking agent comprising polyethylenic functions, and iii) mixtures thereof, c) a component capable of sequestering metal ions selected from the group consisting of: amino carboxylic acid, organo aminopnospnoic acid components, and mixtures thereof.

2. A fabric softener composition according to claim 1, wherein said chelating component is an amino carboxylic acid selected from the group consisting of ethylenediamine-N,N'-disuccinic acid, ethylenediamine tetraacetic acid, N-hydroxyethylenediamine triacetic acid, nitrilotriacetic acid, ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid, trans 1,2 diaminocyclohexane-N,N,N',N'-tetraacetic acid, ethanoldiglycine and mixtures thereof.

3. A fabric softener composition according to claim 1, wherein said chelating component is an organo aminophosphonic acid selected from the group consisting of ethylenediamine tetrakis (methylenephosphonic acid), diethylene triamine-N,N,N',N",N" pentakis (methylene phosphonic acid), 1,1-hydroxyethane 1 1-diphosphonic acid, hydroxyethane dimethylenephosphonic acid and mixtures thereof.

4. A fabric softener composition according to claim 1, wherein said chelating component is present in amount of at least 10 ppm.

5. A fabric softener composition according to claim 1, wherein said associative thickener is selected from the group consisting of copolymers of ethylene oxide and/or propylene oxide with small amounts of $C_8$–$C_{24}$ side chains, hydrophobically modified poly (ethylene oxide and/or propylene oxide/urethanes), alkyl substituted poly (vinyl) alcohols, hydrophobically modified polyacrylic acid polymers and mixtures thereof.

6. A fabric softener composition according to claim 1, wherein said fabric softener is a cationic biodegradable fabric softening material.

7. A fabric softener composition according to claim 1, wherein said composition further comprises one or more electrolyte components.

8. The composition of claim 1 wherein the thickening agent is selected from the group consisting of cross-linked cationic polymers that are derivable from a water-soluble cationic ethylenically unsaturated monomer or blend of monomers which is cross-linked by 5 to 45 ppm of a cross-linking agent comprising polyethylenic functions.

9. The composition of claim 8 wherein the cationic fabric softener is a biodegradable fabric softening material.

10. A fabric softener composition according to claim 8, wherein said chelating component is an amino carboxylic acid selected from the group consisting of ethylenediamine-N,N'-disuccinic acid, ethylenediamine tetraacetic acid, N-hydroxyethylenediamine triacetic acid, nitrilotriacetic acid, ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid, trans 1,2 diaminocyclohexane-N,N,N',N'-tetraacetic acid, ethanoldiglycine and mixtures thereof.

11. A fabric softener composition according to claim 8, wherein said chelating component is an organo aminophosphonic acid selected from the group consisting of ethylenediamine tetrakis (methylenephosphonic acid), diethylene triamine-N,N,N',N",N" pentakis (methylene phosphonic acid), 1-hydroxyethane 1,1-diphosphonic acid, hydroxyethane dimethylenephosphonic acid and mixture thereof.

12. A fabric softener composition according to claim 11 wherein said chelating component is present in amount of at least 10 ppm.

13. A fabric softener composition according to claim 8 wherein said cross-linked thickener is derivable from monomers comprising acrylic monomers.

* * * * *